United States Patent [19]

Ciatteo

[11] Patent Number: 4,575,067

[45] Date of Patent: Mar. 11, 1986

[54] COLLATING MACHINE STACKING BIN INSERT

[75] Inventor: Robert J. Ciatteo, Trenton, N.J.

[73] Assignee: RCA Corporation, Princeton, N.J.

[21] Appl. No.: 679,865

[22] Filed: Dec. 10, 1984

[51] Int. Cl.[4] ..... B65H 39/02

[52] U.S. Cl. ..... 270/58; 271/239; 271/171

[58] Field of Search ..... 270/58; 271/9, 234–235, 271/236, 239, 171, 164, 253

[56] References Cited

U.S. PATENT DOCUMENTS

| | | | |
|---|---|---|---|
| 2,993,692 | 7/1961 | Thomas | 270/58 |
| 3,807,725 | 4/1974 | Bookless | 271/171 |
| 3,934,870 | 1/1976 | Miller et al. | 271/164 |
| 3,936,044 | 2/1976 | Kramer | 271/122 |
| 4,171,127 | 10/1979 | Kish et al. | 270/58 |
| 4,221,379 | 9/1980 | Kamath et al. | 271/171 X |
| 4,343,461 | 8/1982 | Tomimori et al. | 271/22 |

OTHER PUBLICATIONS

"Aligning Paper Tray", IBM Technical Disclosure Bulletin, vol. 19, No. 9, 2-77, p. 3290.

"Sheet Aligner for Multiple Bin Collator", IBM Tech. Discl. Bulletin, vol. 21, No. 11, Apr. 1979, pp. 4385–4386.

"Operating and Service-Manual Ordinamatic", publication date unknown.

"Collators, Folders, Stitchers, Trimmers and Stackers," published by A. B. Dick Co., 1983.

*Primary Examiner*—E. H. Eickholt

*Attorney, Agent, or Firm*—Joseph S. Tripoli; George E. Haas; William Squire

[57] ABSTRACT

A collating machine includes a serial array of vertically oriented stacking bins, each bin receiving a stack of sheet material to be collated. The upper edge of each stack is a reference and needs to be at a machine reference plane. The machine normally places the reference edge of the stacks of each bin in the same reference plane only when the stacks have the same length. An insert for one or more bins adjustably places the reference edge of stacks dimensioned different than the stacks in the remaining bins in the same reference plane.

10 Claims, 5 Drawing Figures

COLLATING MACHINE STACKING BIN INSERT

This invention relates to collating machines, and more particularly, to such machines which are adjustable to collate sheet material of different dimensions.

One kind of collating machine includes a linear array of sheet material stacking bins, each bin receiving a stack of sheet material stacked on edge and inclined with respect to the vertical. A stack in a given bin may contain identical subject matter; the stacks from bin to bin differing in subject matter. The machine collates one sheet at a time from each bin in the ordinal position of the bins in the array.

Push rods push the top sheet of each stack simultaneously up the incline of that stack and onto an overhead conveyor system. The conveyor system serially conveys horizontally the pushed sheets onto a collating plate where the sheets are received and stacked one over the other, in their ordinal position as conveyed. A stapling machine may be located at the collating plate for stapling the collated stack. The machine repeats the process, collating the sheets one at a time from each of the bins until all of the sheets are collated.

An adjustment mechanism positions the sheet material stack of each bin in the same predetermined vertically spaced reference location relative to the overhead conveying system. This insures that the sheets from each of the bins are received simultaneously by the conveying system in the desired order. The adjustment mechanism is positioned to receive sheet material of a given length. That adjustment sets the stacks of each bin in the same reference position in close proximity to the conveying system. The stacks are so set regardless the sheet length of a given set of stacks. However, all stacks during a given collating process are required to have the same length.

By way of example, employing sheet material $8\frac{1}{2}\times 11$ inches in size, the 11-inch dimension may be oriented substantially vertically and the stack adjustably positioned relative to the conveying system to its reference location, i.e., the upper edge of the stack is placed at a reference plane in close vertical proximity to the conveying system. To do this, in all bins, the lower edge of the sheet material which rests on the stack adjustment mechanism is set accordingly. The adjustment mechanism which receives the lower edge of each stack adjusts all such lower edges coplanar.

If the sheet material is changed in dimensions to, for example, $11\times 17$ inches with the longer dimension substantially vertical, the top edge of the 17-inch sheets is located at the same reference plane spaced the same distance from the conveyor system as the top edge of the 11-inch sheet material. Necessarily, the bottom edge of the 17-inch material is in a different plane at a different vertical position than the 11-inch material bottom edge. The stack adjustment mechanism sets all of the stacking bins uniformly to accommodate these different length dimensions of the sheet material.

However, it sometimes occurs that material of different dimensions needs to be collated at the same time. In the above machine, it is required to manually insert sheet material having a length dimension between its lower and upper edge different than the corresponding length dimension of the sheet material of the remainder of the stacks to be collated. This manual insertion is time consuming and burdensome.

According to the present invention, a collating apparatus has an array of bins, each for receiving a stack of sheet material of a given length between first and second stack edges. The apparatus includes first adjustment means for settably placing in unison the first edge of each received stack in a reference plane by setting the position of the second edge. The first edge of a stack of a length different than the given length tends to be offset from the reference plane an amount proportional to the difference between the given and different lengths. The improvement comprises second adjustment means for setting the position of the different length stack first edge at the reference plane regardless the setting of the first adjustment means. The second adjustment means are adapted to be coupled to one or more of the bins.

Figure 1:
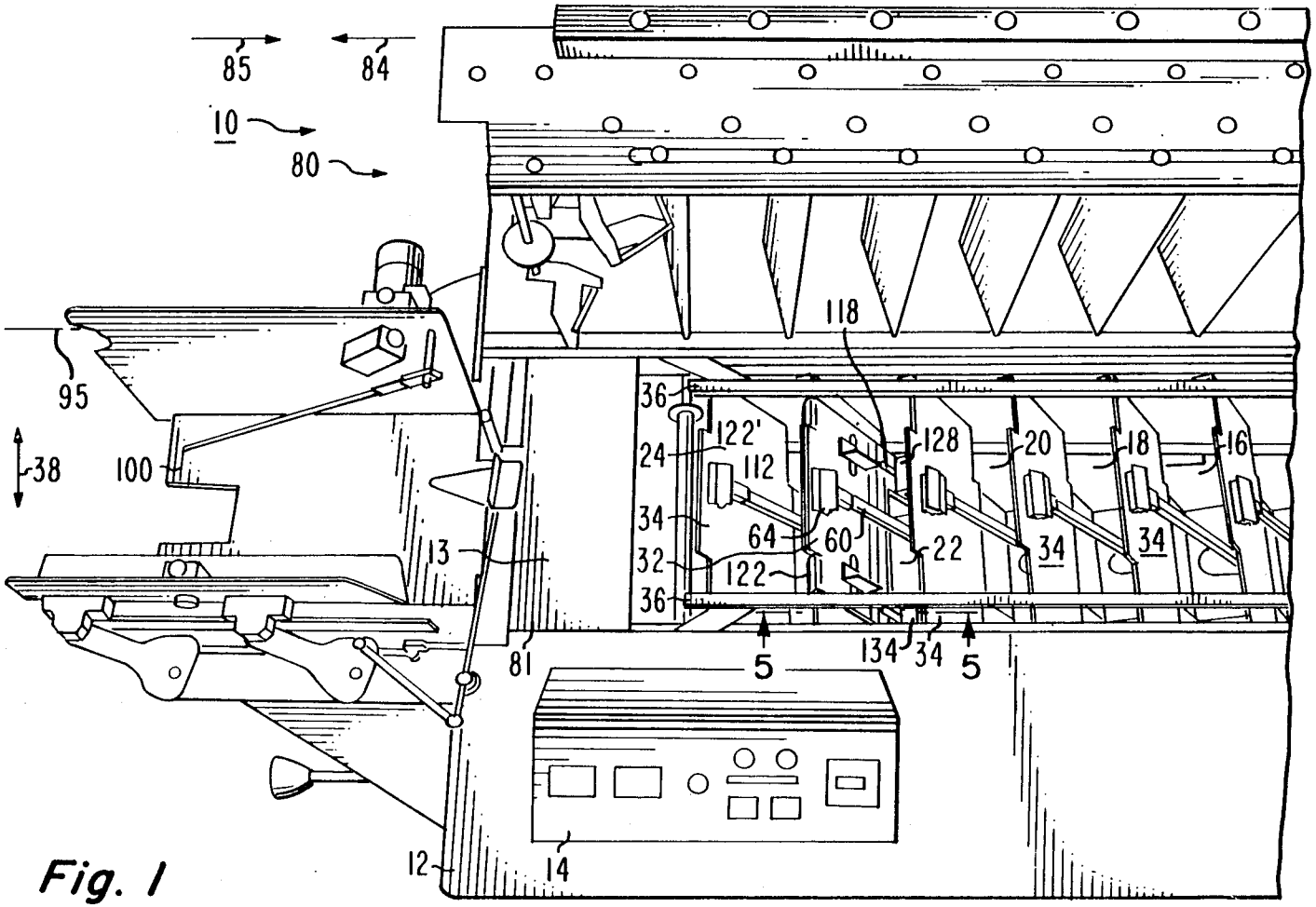
FIG. 1 is a perspective view of a portion of a collating apparatus employing an embodiment of the present invention.

In FIG. 1, machine 10 includes a base 12 to which is secured control 14. Machine 10 is commercially available, and in one form is known as the Ordinamatic manufactured by ORBIDEL of Belgium, and therefore, only so much will be described herein as is necessary for an understanding of the present invention.

Figure 2:
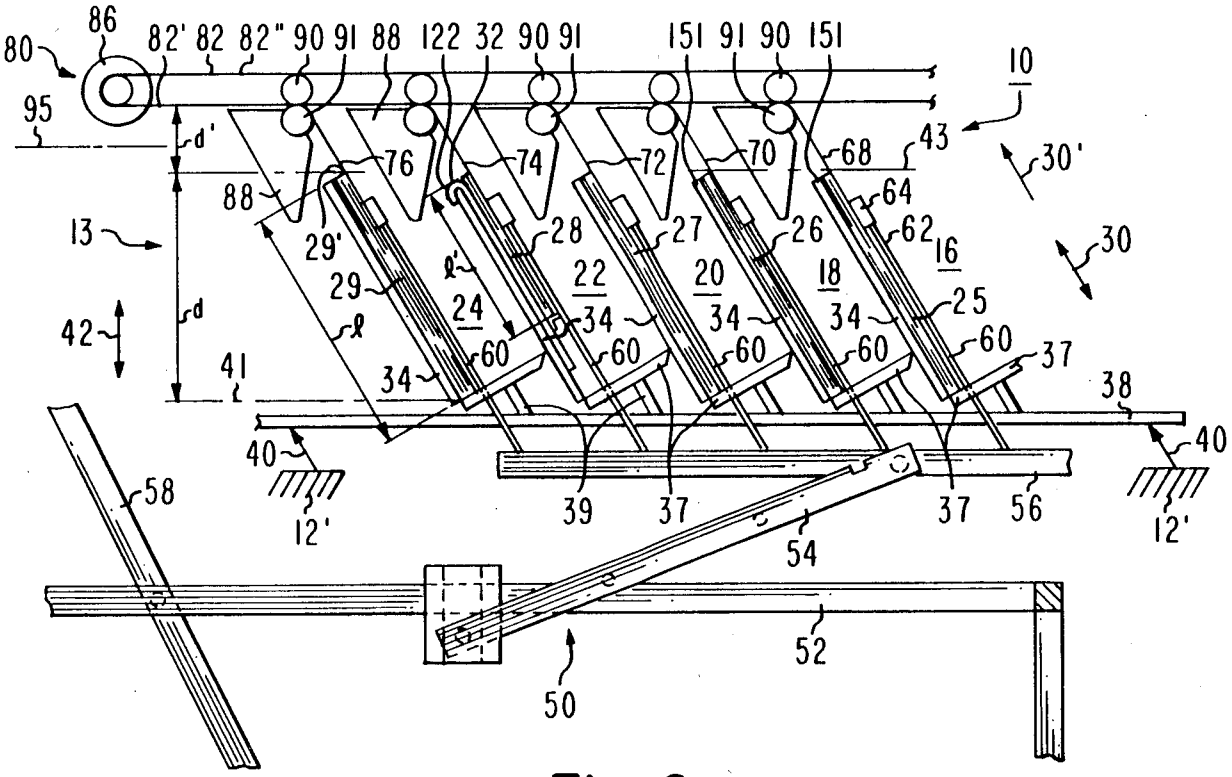
FIG. 2 is a side elevation schematic sectional view of a portion of the apparatus of FIG. 1.

In FIG. 2, located in base 12 is a serial linear array 13 of identical bins 16, 18, 20, 22, 24 and others (not shown). The bins receive respective stacks 25–29 of sheet material, for example, printed pages, which are to be collated. The stacks 25–27, 29 have identical length dimensions l, parallel to directions 30 and a second width dimension (not shown) normal to l and the plane of the drawing sheet. The stack 28 in bin 22 has a length dimension l′ smaller than l and a width dimension (not shown) which may be the same or different as that of stacks 25–27 and 29. By way of example, stack 25 may have a length l dimension of 17 inches and stack 28 may have a length l′ dimension of 11 inches. The width dimension may be $8\frac{1}{2}$ inches for all stacks.

As commercially available, machine 10 cannot process stack 28 having a length l′ dimension different than the length l dimension of the remaining stacks 25–27 and 29. It can process stacks of different width dimensions. Insert 32, in bin 22, FIGS. 1 and 2, is employed according to the present invention to permit machine 10 to automatically process, i.e., collate, such different dimension stacks precluding the prior art manual insertion. Notwithstanding the presence of insert 32, the remainder of machine 10 can be as commercially available without modification. The flexibility of the use of insert 32 in machine 10 to be described below, is that it can be employed in one or more of bins 16–24, as needed, or removed and not used at all, depending on the relative dimensions of the different sheet material stacks being collated.

In FIG. 2, the array 13 of bins is aligned horizontal. Since the bins are identical, the following description of bin 20 is representative. Like reference numerals in the different figures refer to identical parts. Bin 20 comprises an inclined planar stacking plate 34 fixed to base 12, FIG. 1. Plate 34 is substantially vertical, being inclined to the vertical at a relatively small angle, for example, about 30° or less, and is parallel to directions 30. In FIG. 2, bin 20 has a planar stacking foot 37, normal to stacking plate 34, which can move in directions 30 relative to fixed plate 34. Foot 37 is attached to movable bar 38 by a link 39.

All feet 37 of the different bins are attached to bar 38 similarly for translation movement in unison in a selected one of directions 30. An actuating mechanism represented by arrows 40 secured to base 12 represented by symbols 12' displaces bar 38 in directions 30 to locate the corner of feet 37 of all bins in the same horizontal plane 41. Plane 41 may pass through the intersection of the plane of a foot 37 with the plane of that foot's stacking plate 34. Thus, plane 41 is settable in vertical directions 42.

When a stack of sheet material, for example, stack 29, is in a bin such as bin 24, the lower edge of the stack rests on the foot 37 of that bin and the stack broad surface rests on the surface of the stacking plate 34 of that bin. The lowermost corner of that stack is thus located in plane 41. The purpose of adjusting the plane 41 vertical position is to locate the stack upper edge, e.g., edge 29' of stack 29, FIG. 2, in reference plane 43. Reference plane 43 is fixed in location in machine 10. The purpose of reference plane 43 will be explained below.

The important factor to consider is that all stacks in each bin must have their upper edges, such as edge 29', substantially coplanar (in or close to plane 43). Those upper edges may be positioned within a tolerance range of that reference plane a small distance, distance g, FIG. 5, for example, an inch or less in one embodiment, for machine 10 to properly operate. Actuating mechanisms 40, FIG. 2, position the feet 37 of all bins coplanar and positions the location of the bottom stack edge plane 41 so that the plane of the upper edges of all stacks 25–29 corresponding to edge 29', FIG. 2, lie in or are close to the reference plane 43 within distance g. Therefore, machine 10 in its normal intended use employs stacks of the same length dimension l.

Insert 32, FIG. 2, locates the upper edge 28' of its stack 28 in or close to reference plane 43 regardless the length dimension l' of the stack stored on that insert. That is, insert 32 permits the length dimension l' of a given stack to have any value smaller than the value of l of the remaining stacks. The length dimension l' of the stack stored on insert 32 is therefore independent of the location of plane 41 set by mechanisms 40 via feet 37. As can be observed in FIG. 2, movement of plane 41 in vertical directions 42 changes the vertical spacing d between planes 41 and 43, plane 43 remaining fixed.

In FIG. 2, located immediately below the bin array 13 is push rod linkage 50. Linkage 50 comprises links 52, 54, 56, and 58 and others (not shown) which are secured to an operating mechanism (not shown). Link 54 is so moved such that link 56 is moved in translation in one of directions 30. It is to be understood linkage 50 includes supports and pivots for so moving link 56. A plurality of identical push rods 60 are secured to link 56, each push rod being located in a different bin. In bin 16, by way of example, push rod 60 includes a rod 62 connected at one end to link 56 and at its other end to pusher pad 64. Pusher pad 64 includes a friction member (not shown) which rests against the stack top sheet, e.g., sheet 68 of stack 25.

In operation, push rod linkage 50 displaces link 56 in inclined direction 30' and causes each pusher pad 64 to simultaneously push against the top sheet of the corresponding stack, displacing that top sheet from the stack. In bin 18, top sheet 70 of stack 26, is displaced as is top sheet 72, bin 20; sheet 74, bin 22; and sheet 76, bin 24. Push rods 60 simultaneously push all of the top sheets of each bin the same fixed distance as determined by the displacement of link 56 in direction 30'. After the sheets are so pushed, the push rods are returned to the start position to repeat the cycle.

In FIG. 1, a pair of parallel, settable guides 36, which may be long rectangular bars, extend over and along side the array 13 of bins. The guides translate in transverse directions 38 to correspond to the width dimensions of the stacks in the bins.

Located immediately above the bin array 13 is conveyor belt system 80, FIG. 2. System 80 includes an endless conveyor belt 82 whose respective lower and upper portions 82' and 82'' are moved in respective opposite horizontal directions 84 and 85 by drive wheel 86. Conveyor system 80 includes a plurality of side guide plates 88 and a plurality of vertically aligned pairs of guide rollers 90 and 91 and other mechanisms (not shown). A roller 90 and 91 pair correspond to one bin. Roller 91 is located next to the path of the top sheet of each stack. Roller 90 squeezes the belt portion 82' against roller 91, rotating roller 91.

Conveyor system 80 is hinged for rotation about axis 95, FIGS. 1 and 2, parallel to and spaced from the array 13 of bins along one side of the array. The system 80, FIG. 1, is shown rotated 90° to one side of the bin array so that the sheet material stacks 25–29 and so forth, FIG. 2, may be placed in the different respective bins. After the stacks are placed in the bins, conveyor system 80 is rotated 90° to its horizontal orientation, FIG. 2, directly above the bin array 13.

Reference plane 43, FIG. 2, is spaced a distance d' from the lower portion 82' of conveyor belt 82. Since the upper edge of all the stacks in the bins lie in or are close to plane 43 within range g, FIG. 5, those upper edges are all spaced distance d' from belt portion 82' within range g. The distance d' has a value such that the top sheets of all stacks, for example sheets 68, 70, 72, 74, and 76 when pushed in direction 30' are of sufficient length to be simultaneously pushed between the conveyor belt portion 82' and the corresponding lower roller 91.

When a top sheet is pushed over a roller 91, it is forced between that roller and belt portion 82' and is grasped therebetween. Belt portion 82' then conveys the grasped top sheet in direction 84. This action occurs simultaneously for all top sheets in the different bins only when the top sheets reach the region between the belt and rollers 91 simultaneously. For example, in bin 22 top sheet 74 is pushed over roller 91 between the belt portion 82', bending sheet 74 over roller 91. The belt portion 82' simultaneously squeezes the top sheets from all bins against the rollers 91 and moves them toward drive roller 86. All of the top sheets are moved in direction 84 simultaneously in the ordinal position determined by their corresponding bin ordinal position in direction 84. The spacing d' is therefore smaller than the stroke length of push rods 60 and smaller than dimensions l or l' of a given stack to insure the sheets reach the conveyor belt 82.

In FIG. 1, a stacking plate 100 is secured to base 12 at end 81 of the bin array 13. The stacking plate 100 includes a mechanism (not shown) which automatically lowers the plate 100 in response to the weight of the collated stacks as the collated stacks build up thereon. The control 14, FIG. 1, and other mechanism (not shown) repeat the process of pushing the top sheet of the stacks in each of the bins to the conveyor system 80, FIG. 2, collating the sheets onto the stacking plate 100 in rapid sequence.

The problem with the above apparatus is that all of the stacking feet 28, FIG. 2, are adjusted by the adjustment bar 32 relative to reference plane 41. Thus, each of the bins 16–24 can only collate material having the same length dimension l between planes 41 and 43 as discussed above. If, for example, a stack of sheets of length dimension greater than l were to be collated, the upper edge of that stack would interfere with operation of the corresponding lower roller 91 and the placement of the sheets from that stack on the conveyor may be out of sequence. If the length dimension l of one of the stacks of sheet material were substantially smaller than the length dimension l of the remaining stacks, such as length l′ of stack 28, then it is possible that the stroke of pusher rod 60 in direction 30′ would be insufficient to cause the top sheet to pass over its roller 91 and between the belt 82. At best, the timing of that sheet's placement on the conveyor would be erroneous and would cause error in its placement onto the conveyor.

Figure 3:
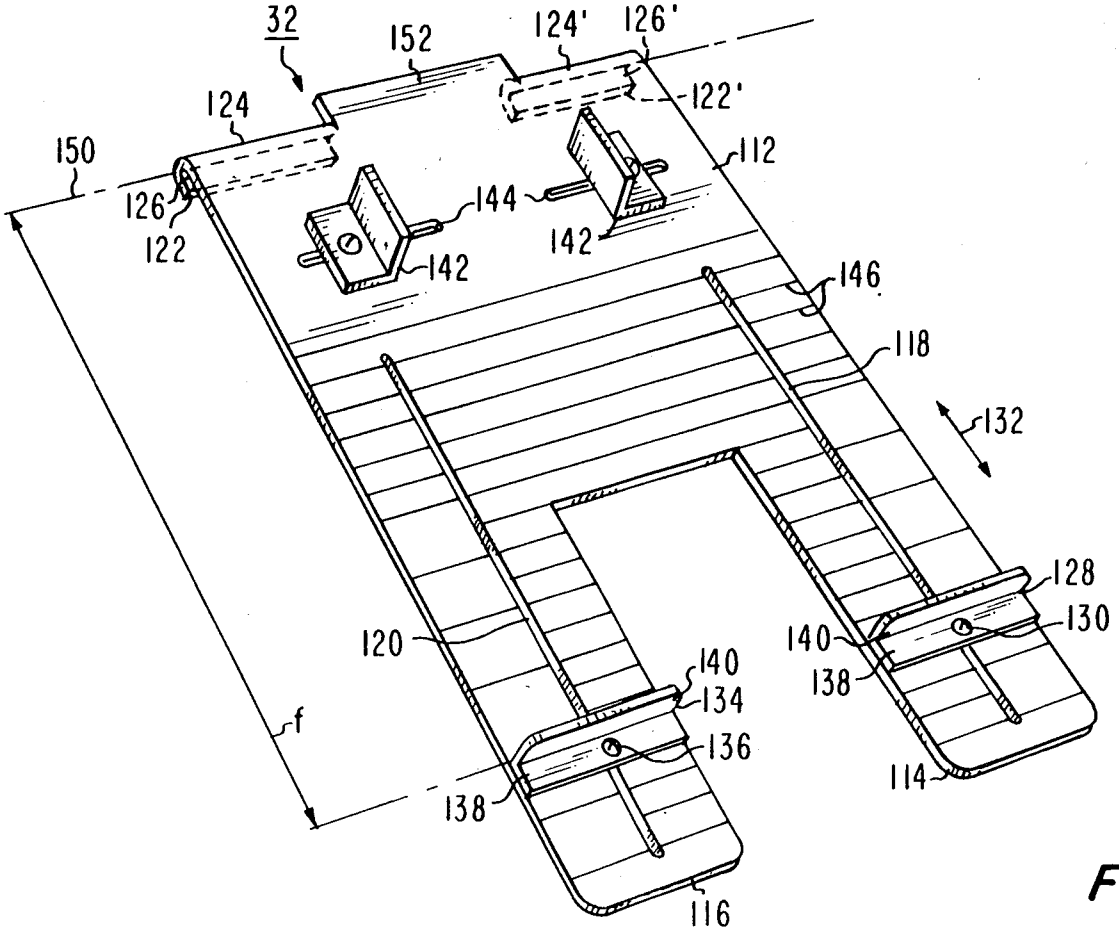
FIG. 3 is an isometric view of a stacking bin insert according to one embodiment of the present invention and employed in the apparatus of FIG. 1.
Figure 5:
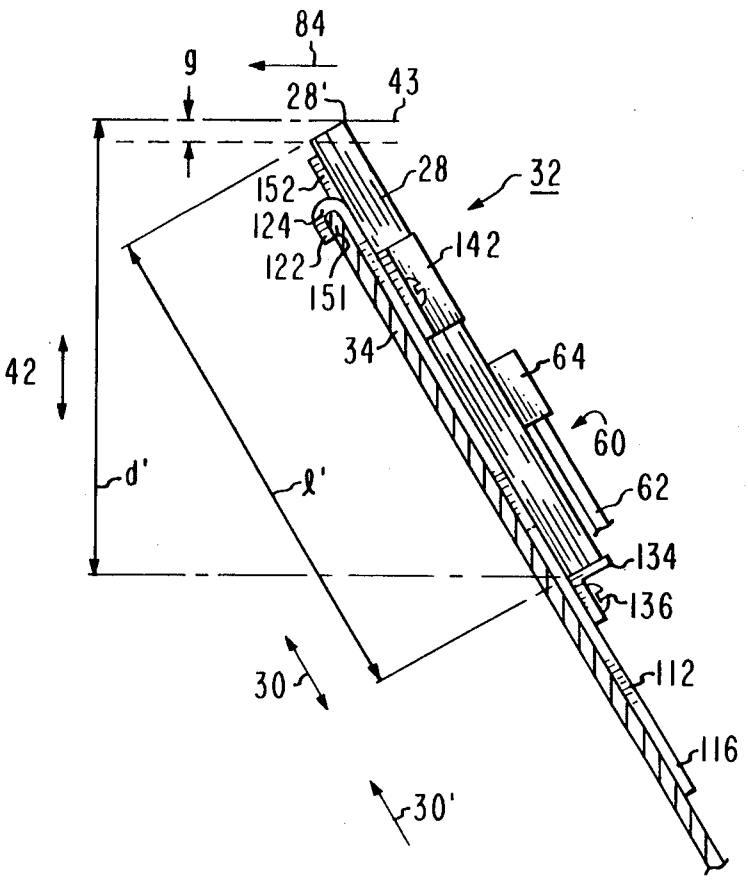
FIG. 5 is a side elevation sectional view of the stacking bin insert attached to the collating machine of FIG. 1 taken along lines 5—5.
Figure 4:
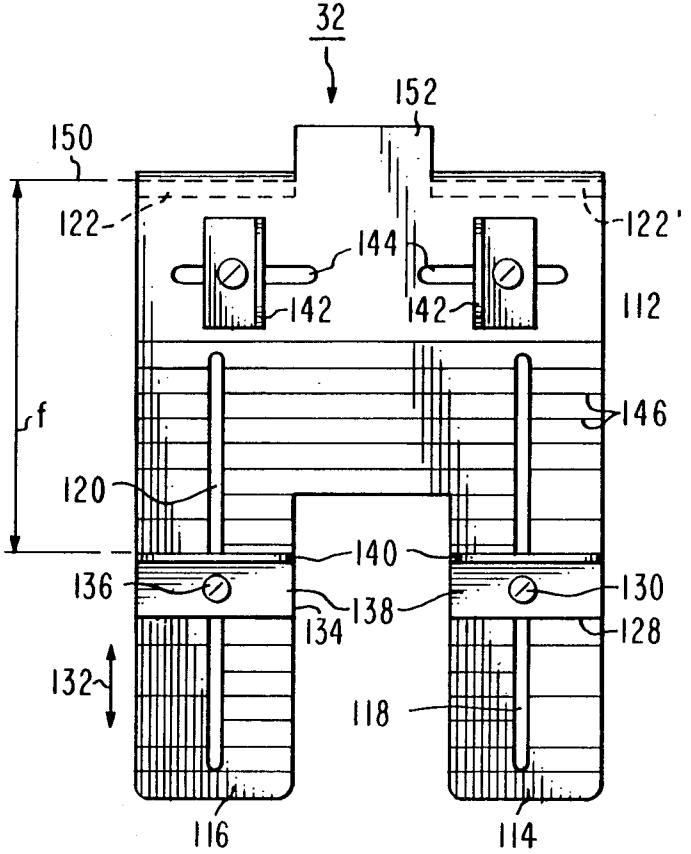
FIG. 4 is a plan view of the stacking bin insert embodiment of FIG. 3.

In accordance with the present invention, a stacking bin insert 32, FIGS. 3 and 4, settably positions the upper edge of any stack dimension l′ on or close to plane 43 within range g, FIG. 5, independent of the location of feet 37. Insert 32 comprises a stacking plate 112 having a pair of depending legs 114 and 116 and an extension 152. Plate 112 also includes two hooks 122 and 122′ at upper respective edges 124 and 124′. Hooks 122 and 122′ have aligned slots 126 and 126′, respectively, which lie on axis 150 and are adapted to slide over and be attached to the upper edge 151, FIG. 5, of the fixed stacking plate 34 of any selected one of the respective bins 16–24, FIG. 2. Edges 151 are coplanar and parallel to reference plane 43 and thus fix the location of insert axis 150 relative to plane 43 regardless which edge 151 receives an insert 32.

Hooks 122 and 122′ may be replaced with a single hook. In the alternative, other means in place of hooks 122 and 122′ may be used to secure insert 32 in place to a bin stacking plate 34. For example, holes may be placed in fixed plates 34 and insert plate 112 can include projections which mate with such holes. Other releasable fastening devices may be used also in the alternative to attach an insert 32 to a bin.

Each leg 114 and 116, FIG. 4, has parallel longitudinal slots 118 and 120, respectively. Leg 114 includes an adjustable L-shaped stacking foot 128 secured via screw 130 in slot 118 and slides in directions 132. Direction 132 is parallel to directions 30, FIG. 2, when the insert 32 is attached to one of the stacking plates 34. A second L-shaped foot 134, which may be identical to foot 128, is slidably secured to slot 120 via screw 136 and is positioned coplanar with foot 128 in a plane normal to slots 118 and 120. A set of graduations 146 may be inscribed on the surface of stacking plate 112 as an aid in setting the position of the stacking feet 128 and 134 relative to axis 150. Because axis 150 is in a fixed position relative to plane 43, feet 128 and 134 when adjusted in directions 132 are adjusted relative to plane 43. A pair of L-shaped stack side guide members 142, which may be identical, are slidably secured in corresponding slots 144, normal to slots 118 and 120, for locating the side edges of a stack of sheet material positioned on insert 32.

In FIG. 5, the distance d′ between the aligned stacking feet 128 and 134 and fixed plane 43 thus may be set at any value independent of the setting of the distance d of all feet 37, FIG. 2, with respect to plane 43. In FIG. 4, the feet 128 and 134 stack locating legs 140 are set a distance f with respect to axis 150. As mentioned above, axis 150 coincides with the upper edge 151 of a bin stacking plate 34 to which insert 32 is attached. Because edge 151 has a fixed spaced relation to plane 43 feet 140 can be set relative to axis 150, and thus to plane 43, with the insert 32 out of a bin.

A preadjusted insert 32, FIG. 2, may be assembled, to one or more of the bins 16, 18, 20, or 24 and so forth. Further, the stacking feet 128 and 134 of the given inserts 32, FIGS. 3 and 4, may be set to different dimensions f to correspond to the respective length dimensions of the stack of sheet material to be inserted in that particular bin.

During the operation of collating machine 10, the conveyor system 80, FIG. 1, is positioned as shown in FIG. 1. A preadjusted insert 32 is assembled to one or more selected bins in accordance with the length dimensions l′ of the corresponding stacks to be collated. The stacks of sheet material to be collated are inserted in each bin in their desired ordinal position. In FIG. 2, stack 28 is inserted in bin 22 onto insert 32. The remaining bins 16, 18, 20, and 24 have sheet material of the same length l which is different than length l′ of stack 28. The feet 37 of each of the bins are positioned accordingly via bar 38. The stacking feet of the insert 32 and each of the stacking bins are set so that the upper edges of each of the stacks of material are substantially coplanar on plane 43 or within range g, FIG. 5. With the stacks of sheet material inserted in each bin, the conveyor system 80 is rotated 90° from the FIG. 1 position to the position of FIG. 2 over the bin array. The machine is then turned on.

Linkage 50 is operated automatically, causing the push rods 60 to push the top sheets of the stacked sheets in the bins simultaneously onto the conveyor system 80 in the desired ordinal position. Conveyor system 80 conveys the serial stream of sheets to the stacking plate 100, FIG. 1, stacking the collated sheets in the order as received by plate 100.

Suppose, however, that the collated stack comprises a plurality of sheets of one length dimension l′, and only one sheet of that stack has a length dimension l greater than l′. In this case, an insert is employed in all bins receiving a stack of sheets of the shorter length l′. That one bin receiving the stack with the greater length l has no insert 32. In this case, foot 37 for that one bin is set to correspond to that greater length dimension l. Thus, it does not matter if most sheets are short or most sheets are long. The inserts accommodate the sheets with the shorter length.

In the alternative, by providing the plates 34 (FIGS. 1 and 2) of each bin with slots such as slots 118 and 120 (FIGS. 3 and 4) feet such as feet 128 and 134, may be independently attached to a selected plate 34. The position of such feet 128 and 134 would be set to accommodate a stack of length l′, FIG. 2. This could preclude the use of a separate plate 112. However, the inclusion of slots 118 and 120 in place 34 could require modification of existing machines 10. The use of inserts 32 require no such modification.

What is claimed is:

1. In a collating apparatus having an array of bins, each bin including stack receiving means for receiving a stack of sheet material of a given length between first and second stack edges, said apparatus including first adjustment means coupled to the stack receiving means and including settable stack second edge receiving means located in each bin for settably placing the first edge of each said received stack in a reference plane by setting in unison the position of said received second edge, the first edge of a stack of a length different than the given length tending to be offset from said reference plane an amount proportional to the difference between the given and different lengths, the improvement therewith comprising:

second adjustment means including means adapted to be releasably coupled to any selected one of said bins, said second adjustment means including means for receiving said second edge of said stack of different length for setting the position of the first edge of said stack of said different length on said reference plane regardless the setting of the first adjustment means in said selected one bin.

2. The improvement of claim 1 wherein said bins each include a fixed stacking plate and a first foot movable by said first adjustment means relative to the fixed plate, said second adjustment means for receiving said second edge including a second movable foot adapted to receive in abutting relation said second edge of the different length stack, said means adapted to be releasably coupled including means for releasably attaching said second movable foot to said fixed plate.

3. The improvement of claim 1 wherein said bins each include a fixed stacking plate, said means for setting including a detachable stacking plate, and a stack receiving foot slidably secured to the detachable plate for movement along said length to receive said second edge, and means attached to said detachable plate mating with an edge of said fixed plate for releasably juxtaposing said detachable plate over said fixed plate.

4. A sheet material stacking bin insert for a collating apparatus having means for collating a plurality of stacks of sheet material, said apparatus having a plurality of bins, each bin having a stacking wall and a first settable stacking foot for locating a reference edge of a stack of sheet material to be collated of a given length at a reference location spaced from the collating means of said apparatus, said apparatus including means for setting the first stacking foot of all said bins in unision for receiving a second edge of a stack spaced from the first edge of said given length and means for uniformly setting the position of said first foot a distance from said reference location corresponding to said given length, said insert for receiving a sheet material stack of a length different than said given length and for placing the reference edge of the stack with the different length at said reference location, said insert comprising:

a plate member;

means attached to the plate member for releasably securing the plate member juxtaposed with the stacking wall of a selected bin; and a second stacking foot secured to the plate member adapted for settably positioned the reference edge of the stack of sheet material of different length at said reference location.

5. The insert of claim 4 wherein said plate member includes at least one slot and means for releasably securing said second foot to the plate member and mating with said slot for displacement along said slot.

6. The insert of claim 4 wherein said means for releasably securing the plate member includes means attached to the plate member at an edge thereof mating with an edge of said bin stacking wall.

7. In a collating apparatus having a plurality of bins each bin having the same reference plane and including a stacking wall having an edge, said bins each having a first stacking foot, said apparatus including means for setting said feet in unison in a first position relative to said reference plane, each foot being adapted to receive a first stack of sheet material having a given length which correpsonds to the spacing set between said foot position and the reference plane, each foot for placing one edge of the first stack in said reference plane by locating a second edge in said first position, a bin insert for receiving a second stack of sheet material having a length different than said first stack length and for placing an edge of the second stack in said reference plane comprising:

a wall member;

means attached to said wall member adapted to releasably juxtapose said wall member with a selected bin stacking wall; and a second settable foot attached to the wall member for setting the spacing between the second foot and said reference plane to correspond to the second stack and thereby place the different length stack edge in said reference plane.

8. The insert of claim 7 wherein said means adapted to releasably juxtapose said wall member include hook means adapted to slip over a selected stacking wall edge.

9. In a collating apparatus of the type including an array of bins arranged in a row in a given order, each bin for receiving a stack of sheet material, said bins each adapted to receive like dimensioned sheet material, said array of bins including means for placing one edge of a plurality of first stacks of sheet material of a given length in a first plane to locate a second edge in a reference plane, said apparatus further including sheet selecting means for simultaneously removing the top sheet of each said stack, conveying means for conveying said removed top sheets in the order of said array only when the second edge is at said reference plane, and stacking means for receiving said conveyed top sheets in said given order and for stacking said sheets in said received order, the improvement therewith comprising bin insert means including means for selectively releasably securing said insert means to at least one of said bins and adapted to receive and store a second stack of sheet material having a length different than said given length and including means adapted to position said second stack second edge at said reference plane regardless the position of its one edge relative to the first plane.

10. The apparatus of claim 9 wherein said bins each comprise a first plate fixed in place and a first settable foot, said apparatus including means for spacing the first foot of all said bins a first distance from said conveying means, said bin insert means comprising a second plate, means secured to the second plate for attaching the second plate to and juxtaposed over the first plate of said at least one bin, and a second foot adjustably secured to the second plate for setting the second foot spacing to said conveying means a second distance different than the first distance.

* * * * *

UNITED STATES PATENT AND TRADEMARK OFFICE
CERTIFICATE OF CORRECTION

PATENT NO. : 4,575,067 (Page 1 of 2)

DATED : March 11, 1986

INVENTOR(S) : Robert Joseph Ciatteo

It is certified that error appears in the above-identified patent and that said Letters Patent is hereby corrected as shown below:

Column 2, line 42, "1" should be --ℓ--.
line 43, "1" should be --ℓ--.
line 45, "1'" should be --ℓ'-- and
"1" should be --ℓ--.
line 48, "1" should be --ℓ--.
line 49, "1'" should be --ℓ'--.
line 52, "1'" should be --ℓ'--.
line 53, "1" should be --ℓ--.

Column 3, line 45, "1" should be --ℓ--.
line 48, "1'" should be --ℓ'--.
line 49, "1'" should be --ℓ'--.
line 51, "1" should be --ℓ-- and
"1'" should be --ℓ'--.

Column 4, line 67, "1" should be --ℓ-- and
"1'" should be --ℓ'--.

Column 5, line 15, "1" should be --ℓ--.
line 17, "1" should be --ℓ--.
line 21, "1" should be --ℓ--.
line 23, "1" should be --ℓ--.
line 24, "1'" should be --ℓ'--.
line 32, "1" should be --ℓ--.

Column 6, line 27, "1'" should be --ℓ'--.
line 32, "1" should be --ℓ-- and
"1'" should be --ℓ'--.
line 51, "1'" should be --ℓ'--.
line 52, "1" should be --ℓ--.
line 53, "1'" should be --ℓ'--.
line 54, "1'" should be --ℓ'--.
line 55, "1" should be --ℓ--.

UNITED STATES PATENT AND TRADEMARK OFFICE
CERTIFICATE OF CORRECTION

PATENT NO. : 4,575,067 (Page 2 of 2)

DATED : March 11, 1986

INVENTOR(S) : Robert Joseph Ciatteo

It is certified that error appears in the above-identified patent and that said Letters Patent is hereby corrected as shown below:

Column 6, line 57, "1" should be --ℓ--.
line 66, "1'" should be --ℓ'--.

Column 7, line 50, "unision" should be --unison--.

Column 8, line 14, "correpsonds" should be --corresponds--.

Signed and Sealed this

*First* Day of *July 1986*

[SEAL]

*Attest:*

DONALD J. QUIGG

*Attesting Officer*

*Commissioner of Patents and Trademarks*